United States Patent [19]

Thomas

[11] Patent Number: 4,972,897

[45] Date of Patent: Nov. 27, 1990

[54] SPIRAL SPRUE LOOP

[75] Inventor: William R. Thomas, Gainesville, Ga.

[73] Assignee: MDS Products Inc., Anaheim, Calif.

[21] Appl. No.: 473,832

[22] Filed: Feb. 2, 1990

[51] Int. Cl.[5] ..... B22C 9/04

[52] U.S. Cl. ..... 164/35; 164/133; 164/361; 164/362

[58] Field of Search ..... 164/34, 35, 133, 135, 164/361, 362

[56] References Cited

U.S. PATENT DOCUMENTS

| | | | |
|---|---|---|---|
| 2,196,505 | 4/1940 | Morton | 164/35 |
| 4,396,054 | 8/1983 | Cole | 164/35 |
| 4,542,780 | 9/1985 | Almér | 164/34 |
| 4,558,841 | 12/1985 | Engelman et al. | 164/35 |
| 4,676,294 | 6/1987 | Berger | 164/35 |

FOREIGN PATENT DOCUMENTS

| | | | |
|---|---|---|---|
| 61-169151 | 7/1986 | Japan | 164/34 |

OTHER PUBLICATIONS

Preat Corporation, Preci-Roto Sales Brochure, Copywright 1981, 452 Penn Ave., San Mateo, Calif. 94401.

*Primary Examiner*—Richard K. Seidel
*Assistant Examiner*—Rex E. Pelto
*Attorney, Agent, or Firm*—Kenneth E. Darnell

[57] ABSTRACT

Apparatus useful in forming a mold from a wax pattern in an investment casting process, the invention provides a loop element having arm elements which spiral downwardly from and inwardly of the loop element to a base element. Sprue pins mount wax patterns to the loop element in a casting process known as the "lost wax" technique, the apparatus of the invention being particularly useful in the environment of a dental laboratory for formation of crowns and the like of high density. The loop element and arm elements of the apparatus leave channels in the investment material on "burn out" which quickly accelerate a casting material, such as a metal alloy, into the formed mold or molds with a reduction of turbulence which results in fewer defective castings. The channel geometry provided by the apparatus provides benefits due to a lack of right angles or sharp corners which restrict the flow of casting material into the mold or molds.

49 Claims, 2 Drawing Sheets

SPIRAL SPRUE LOOP

BACKGROUND OF THE INVENTION

1. Field of the Invention

The invention relates generally to method and apparatus for forming castings such as by lost wax processing and particularly to such methods and apparatus capable of use in forming dental castings of high quality.

2. Description of the Prior Art

The casting of useful items by processes known generally as "lost wax" processes has long been known. In such a process, a pattern is embedded in an investment material to form a mold from which the material forming the pattern can then be removed and replaced by a casting material such as a molten metal or metal alloy. The pattern itself is typically formed by an artisan skilled in the design and shaping of items such as jewelry, dental prostheses, etc. While patterns may be formed of various materials, it is usual that a pattern be formed of wax since wax can be readily removed from an investment material when a mold is formed in such a material such as by heating. The wax pattern embodies the shape and detail of an item which is to be produced in the mold which is eventually formed. The size, shape and detail embodied in the wax pattern must be duplicated by the investment material with which the pattern is surrounded to cause mold formation. The investment material itself is chosen for heat resistance and strength so that the wax pattern can be burned away in mold formation. The investment material must also be strong enough to allow a forceful introduction of a casting material such as a molten metal or metal alloy. Such processes have been commonly used in the formation of jewelry and similar items. However, a particular use for such processing involves the forming of dental crowns, bridges and similar dental prostheses. In the formation of devices of this nature, it is desirable that castings made from the molten metal be dense and not be subject to voids or conditions known as "shrink spot porosity" or the like. In order to form quality castings, particularly dental castings, present technology is improved by the sprue forming loop of the present invention which facilitates formation of a casting mold whereby a casting material can be quickly accelerated to the final destination within the mold since the casting material is not caused to negotiate right angles or sharp curves while traveling into the mold.

SUMMARY OF THE INVENTION

The invention provides method and apparatus for forming a mold in an investment material, the apparatus comprising a sprue forming structure formed of a loop element and having arm elements which spiral from the loop element to a base element. The method of the invention relates to the use of the apparatus in the formation of a mold formed from a wax pattern, the mold being useful in a casting process similar to lost wax techniques. The method and apparatus of the invention are particularly useful in the environment of a dental laboratory for formation of crowns, bridges and the like with the resulting products being of exceptionally high density and having exceptionally precise fit.

The spiral sprue loop of the invention is attached to a sprue base of conventional design with the assembly thus formed being embedded in a conventional investment material held within a casting ring. The sprue forming loop of the invention is best formed of a low-residue wax material which can be efficiently burned out during mold formation. Wax patterns mounted to the sprue forming loop by means of sprue pins form molds corresponding to crowns, bridges and the like on burn out. The sprue forming loop of the invention provides advantages not available with prior art apparatus and methodology. In particular, the loop allows mounting of a large number of wax patterns so that molds for many different castings can be formed simultaneously and simultaneously utilized to cast the desired products. Production can thereby be at least doubled over prior art practices. A further advantage of the sprue forming loop of the invention is the fact of defect reduction in the eventual castings, this reduction occurring due to the shape of the mold formed by the sprue forming loop. The geometry of the sprue forming loop results in the production of sprue channels which do not restrict flow of a casting material, such as a metal or metal alloy, on introduction of the casting material into the mold. The sprue channels thus formed reduce turbulence of the casting material since the sprue channels do not contain right angles or sharp curves which can cause restriction of flow of the casting material.

Accordingly, it is an object of the invention to provide method and apparatus for producing an improved mold from which castings can be produced with a reduction in casting defects and with improved casting density.

It is another object of the invention to provide method and apparatus particularly useful in forming dental castings such as crowns, bridges and the like.

It is a further object of the invention to provide a spiral sprue forming loop which allows mounting of multiple wax patterns by means of conventional sprue pins such that greater numbers of castings can be formed from a resulting mold, the castings being of improved quality by virtue of a reduction of turbulence in casting material being introduced into the mold.

Further objects and advantages of the invention will become more readily apparent in light of the following detailed description of the preferred embodiment.

DESCRIPTION OF THE PREFERRED EMBODIMENTS

The spiral sprue loop of the invention is used in an otherwise conventional "lost wax" mold forming process. The spiral sprue loop can universally be used with equipment standard in the practice of such mold forming techniques. Although spruing techniques are well known, particularly in the formation of molds by investment techniques, a very brief description will now be given of the conventional mold forming process within which the apparatus of the invention finds utility.

Figure 2:
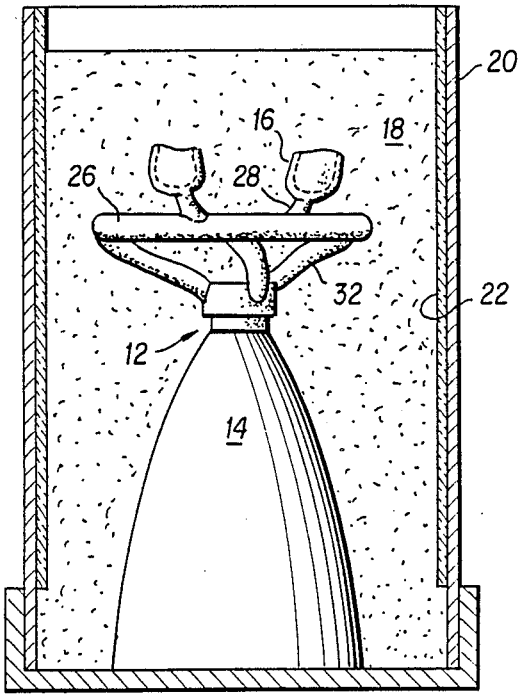
FIG. 2 is a side elevational view in partial section of the assembly of FIG. 1 shown embedded within an investment material held within a casting ring prior to a burn out operation.
Figure 3:
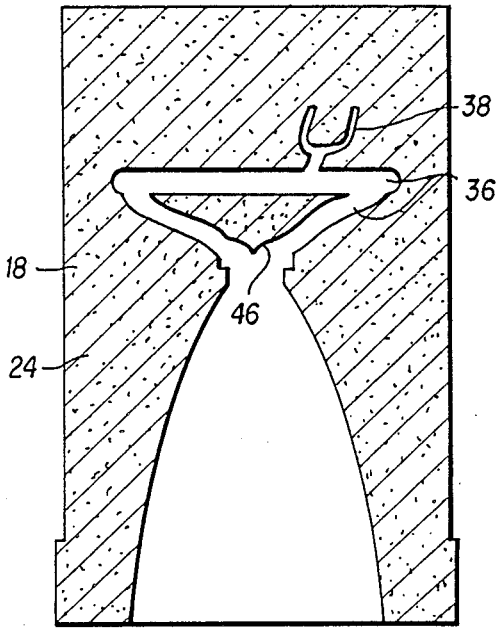
FIG. 3 is a side elevational view in section of a mold formed on burn out of the assembly of FIG. 2.

FIGS. 2 and 3 of the drawings can conveniently be used to reference such conventional processes. Referring now to FIGS. 2 and 3, apparatus which is otherwise conventional except for spiral sprue loop 10 is seen as used in an investment mold forming process. In a conventional process and apparatus, the sprue loop 10 would be replaced by a sprue former (not shown) which would essentially take the form of a substantially straight, runner bar mounted to apex 12 of sprue base 14, that is, essentially at the location of mounting of the loop 12 to the base 14. A conventional sprue pin mounted to a sprue base 14 at one end would have a wax pattern such as the wax pattern 16 formed on the free end of a sprue pin mounted to the runner bar, this wax pattern having been carefully developed by an artisan to a particular size and shape and with particular detail. The ultimate goal of such mold forming techniques is the formation of a casting, such as a metal casting, having the precise size, shape and detail of the wax pattern 16. A mold capable of forming such a metal casting is formed by embedding the wax pattern 16 in an investment material 18. The investment material 18 is a conventional material having a fine powder form like unhydrated plaster which is poured over the wax pattern 16 (and sprue base 14 along with a sprue forming element), a casting ring 20 mating with portions of the sprue base 14 acting to define a space within which the investment material 18 is contained. The casting ring 20 is preferably formed of stainless steel as is conventionally known in the art, the ring 20 further being provided with a woven fiber liner 22 also of conventional design. After embedment of the wax pattern 16 within the investment material 18, the wax pattern 16 and investment material 18 are subjected to heat in order to burn out the wax pattern and the pathway or channel from the wax pattern to the exterior of the mold which is formed by the heat-induced solidification of the investment material 18. In this manner, the mold shown generally at 24 in FIG. 3 is thus formed.

A large body of technology exists relative to formation of molds such as the mold 24. A casting material, such as a molten metal or metal alloy, is then injected into such molds using a centrifuge for formation of a casting. Castings of this type can be used in a variety of situations which vary from jewelry items to dental prostheses. While the present invention will be described within the environment of a dental laboratory for formation of castings useful as crowns, bridges and the like, it should be understood that the apparatus and method of the invention can be utilized to form castings useful in other situations.

A substantial body of technology exists relative to the apparatus and processes involved in the formation of such molds and castings produced from such molds. It is not believed necessary to provide additional detail relative to this prior body of art. However, it is desirable to recognize that the prior art has not provided investment mold forming methodology and apparatus capable of producing the number of castings as can be provided through the use of the spiral sprue loop 10 and the methodology associated therewith. Further, the prior art has not provided castings of the consistent quality obtainable through practice of the present invention. In essence, the spiral sprue loop 10 of the invention acts as a sprue "bar" to form a sprue channel, a sprue channel being best defined as a hole or opening into a mold through which a casting material such as metal is injected into the mold. In the prior art, sprue formers additionally take the form of sprue pins which can be formed of metal, plastic or wax. Regardless of the material from which such sprue formers are fabricated, it is necessary to remove the sprue former at some point during the fabrication of the mold so that a sprue channel is available for casting material to be introduced into the mold for forming of castings. The wax pattern 16 is itself formed preferably of wax so that the wax can be "burned out" during heating as aforesaid in order to form a mold chamber in the investment material.

Figure 1:
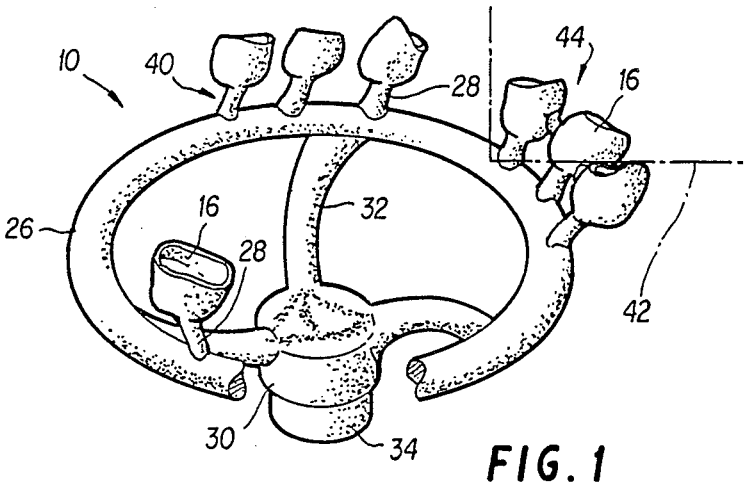
FIG. 1 is a perspective view of the sprue forming loop of the invention and having wax patterns mounted by means of sprue pins on the loop and with the loop being mounted to the sprue base prior to embedment of the assembly shown in the drawing in an investment material.

Referring now to all of the drawings and particularly to FIG. 1, the spiral sprue loop 10 of the invention is seen to have several wax patterns 16 mounted to runner loop element 26 by means of sprue pins 28. The loop element 26 connects to a base element 30 by means of spiral arm elements 32. The sprue loop 10 can be formed with three spiral arm elements 32 as shown. However, it should be understood that the sprue loop 10 can be formed with a number of arms other than three without departing from the scope of the invention. The spiral arm elements 32 terminate downwardly from and inwardly of the loop element 26 and the base element 30 which is preferably annular in conformation and which can be provided with a central nib 34 to facilitate mounting of the loop 10 to a sprue base 14 as is best seen in FIG. 2. The spiral arm elements 32 are intentionally curved such that molten alloy forced into the sprue channels in a mold formed from the loop 10 is caused to spin, thereby eliminating the adverse effects of centrifugal force occasioned through use of conventional centrifugal casting equipment.

The entirety of the sprue loop 10 and the sprue pins 28 act to support the wax pattern 16 on the sprue base 14 during the investing process. Further, the loop 10 and the sprue pins 28 further act to form a sprue channel 36 such as is best seen in FIG. 3. The sprue channel 36 provides an escape route for molten wax from the wax pattern 16 and from the loop 10 itself during wax elimination occurring during burn out. The sprue channel 36 further acts to provide a pathway for the casting material, typically a molten metal or metal alloy, the pathway extending from the exterior surface of the mold 24 and into interior mold chamber 38 internally of the mold 24, the mold chamber 38 having been formed on burn out of the wax pattern 16. A still further purpose of the sprue channel 36 formed on burn out of the sprue loop 10 and the sprue pins 28 is to provide a reservoir of molten metal or casting material from which the casting may draw to compensate for volume loss occurring as metal shrinks during solidification during casting.

The sprue loop 10 is preferably formed of a wax material having a low ash residue on burn out, such material being known in the art. Low-residue plastic materials known in the art can also be used but does not burn out as well as the wax material. Plastic materials usually leave microscopic residue and is therefor less desirable than the wax material of choice. Plastic materials also require higher burn out temperatures. The important consideration is that the sprue channel 36 is free of wax material or plastic material and is open and clear after burn out for introduction of a molten metal or metal alloy comprising the casting material.

The sprue pins 28 are preferably formed of the same wax material as forms the sprue loop 10. A wax material, such as the wax material forming the wax pattern 16 and the loop 10 is used to connect one end of each sprue pin 28 to the wax pattern 16, the other end of the sprue pin 28 being attached to the loop element 26 by means of the same wax material. Such a process is referred to as "luting" and this luting process per se is conventional in the art. Similarly, the sprue loop 10 is luted to the apex 12 of the sprue base 14 through use of a similar wax material. The wax material used for luting is carefully formed at the several junctions or points of attachment in a manner which results in a smooth sprue channel formation. These connection techniques are well known in the prior art.

Referring again to FIG. 1, the sprue loop 10 is seen to be shaped such that the mold produced as aforesaid causes turbulence to be minimized as the casting material flows into the mold chamber 38 as seen in FIG. 3. The mold shape produced by the spiral arm elements 32 allows casting metal to flow in one direction quickly and smoothly without restrictions which cause turbulence. In casting, turbulence is a condition which produces undesirable porosity in the surfaces of castings. In processes involving the casting of dental prostheses, it is particularly desirable to produce high density castings which do not have defects such as surface porosity. In using the sprue loop 10, the wax patterns 16 are placed in a circular configuration around the outside perimeter of the loop element 26. The wax patterns 16 mounted by the sprue pins 28 are tilted toward the perimeter of the casting ring 20 so that the patterns 16 avoid being placed within a thermal zone which occupies the approximately 15% of the interior of the mold about the longitudinal axis thereof. This thermal zone is recognized as being that part of the mold wherein uncontrolled expansion occurs, the result being ill-fitting castings and warped bridges. Use of the sprue loop 10 results in the eventual productions of more dense castings having sharper margins and which fit the patient more precisely.

The sprue pins 28 mounting the wax patterns 16 are preferably formed of wax and are attached to the loop element 26 at the same angle at which the spiral arm elements 32 meet the loop element 26. This mounting technique produces a mold wherein the casting material is not forced to make a 90° or greater turn as the casting material rushes through the sprue channel 36 and into the mold chamber 38. In mounting the wax patterns 16 to the loop element 26, the sprue pins 28 are attached to the wax patterns 16 through the use of spruing wax in a conventional manner. Conventionally, eight gauge sprues, approximately 3 mm long, are used for "slow moving" metals such as high palladiums or for bulky castings while ten gauge sprues, approximately four to five mm long, are used for most non-precious or fluid metals. The sprued wax patterns 16, also referred to as copings, are mounted to one of the sprue pins 28 and are then luted to the loop element 26 at approximately a 45° angle, that is, at an angle which is continuous with the direction of the flow of metal in the eventual mold as is seen most simply at 40 in FIG. 1. When mounting a plurality of sprued copings essentially radially on the loop element 26 as shown at 42 in FIG. 1, it is desirable to maintain the sprued copings within a 90° angle as referenced in phantom.

Still referring to FIG. 1, a bridge 44 is mounted to the loop element 26 by means of more than one sprue pin 28. All of the sprue pins 28 used to sprue the bridge 44 are attached with a tilt in the same direction and are oriented as noted above. Thus, the sprue pins 28 mounting the bridge 44 are mounted to the loop element 26 at angles which orient in the same direction corresponding to the direction of metal flow in the eventual mold. When combinations of bridges and single copings are being sprued, the bridges should first be mounted on innermost positions on the loop element 26 with the single copings being positioned about outside locations of the loop element 26. Curved anterior bridges (not shown) of five or more units must occasionally be sprued. In such situations, secondary sprues are attached from the lingual. In this and other situations, the sprue pins 28 are angled in the direction of metal flow in the eventual mold. When casting full metal crowns or excessively bulky castings, secondary sprues should be cut to 3 mm in order to allow the loop-shaped sprue channel 36 to act as a reservoir.

Figure 4A:
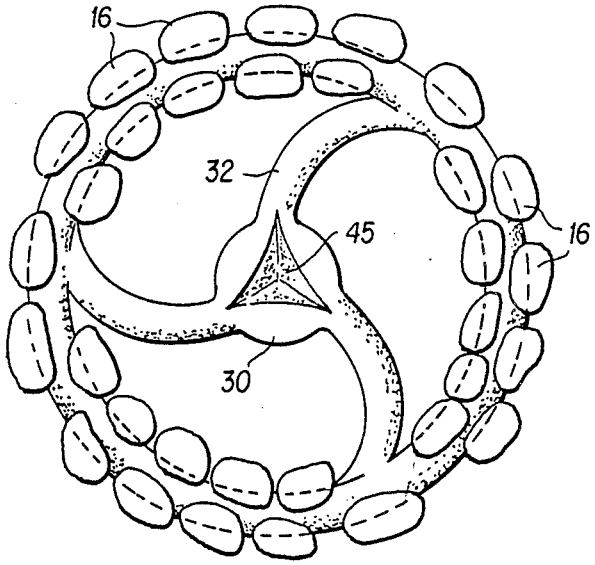
FIG. 4A is a plan view of the sprue forming loop of the invention shown with a plurality of wax patterns sprued to the loop.
Figure 4B:
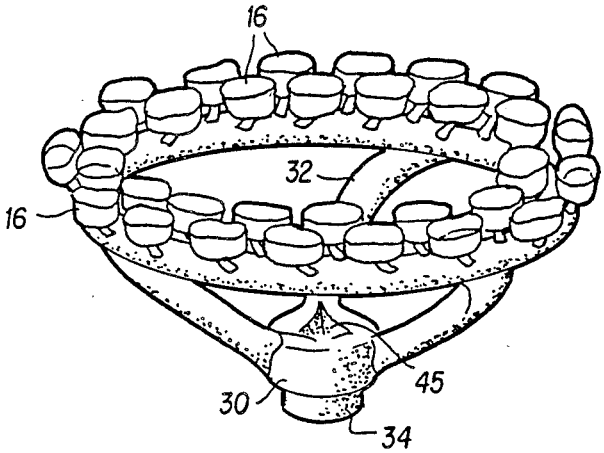
FIG. 4B is a perspective view of the assembly of FIG. 4A.

Referring now to FIGS. 4A and 4B, it can be seen that two rows of wax patterns 16 can be attached to the loop element 26, a first inner row being attached by placement of the wax patterns 16 directly above the loop element 26 with the sprue pins 28 tilting the wax patterns 16 slightly inside the loop element 26. An outer row of wax patterns 16 is then positioned immediately outside the inner row with the sprue pins 28 angling the wax patterns 16 slightly outwardly of the loop element 26. In such an arrangement, none of the wax patterns 16 are positioned in the middle 15% of the mold, that is, within the thermal zone as referred to hereinabove.

Figure 5:
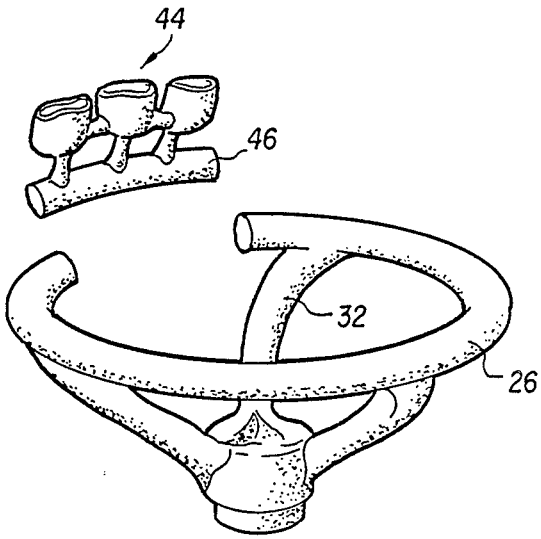
FIG. 5 is a perspective view of the sprue forming loop of the invention shown with a section of the loop removed in a particular spruing technique according to the invention.

Referring now to FIG. 5, it can be seen that small bridges, that is, bridges having less than 5 units, are best attached to a section 46 of the loop element 26 which has been cut from the loop 10. The sprue pins 28 mounting the small bridge are attached to the section 46 and then the section 46 is reluted into the loop element 26.

Use of the spiral sprue loop 10 provides substantial advantages over prior practice. In particular, a much greater number of castings can be produced, these castings being of higher quality due to the fact that the sprue channels 26 thus formed in the eventual mold do not restrict flow of molten casting material. This lack of flow restriction due to the elimination of right angles or sharp corners acts to reduce turbulence in the metal flow and therefore leads to a reduction of defects in the metal castings. Since the sprue channel 26 in the eventual mold only exhibits "soft" curves, the molten metal alloy is accelerated to its final destination as quickly as possible.

Referring now to FIG. 3 and to FIG. 4A, the upper surface of the base element 30 is seen to be formed with a substantially triangular depression 45 having "soft" angles. In the mold 24, the depression 45 causes formation of a reversed cup or dimple 46. The dimple 46 essentially has three side faces, one each of which aligns with the direction of flow of metal alloy injected into the mold. The dimple 46 thus causes a low impact or "soft" entry of the molten metal into the mold.

The mold 24 as shown in FIG. 3 produced according to the invention can be used with casting apparatus for varying description. While most prior art casting apparatus are centrifugal in nature, the mold 24 can be used with other casting apparatus.

While the invention has been described relative to an explicit embodiment thereof, it should be understood that the invention can be practiced with variation from the explicit embodiment without departure from the intended scope of the invention. Further, while the invention has been described relative to use in a dental laboratory environment for production of castings having dental utility, it should be understood that the invention can be used in a variety of situations to produce castings of high quality having utility other than dental utility. Accordingly, the scope of the invention is to be defined by the recitations of the appended claims.

What is claimed is:

1. Apparatus useful in the fabrication of a mold, comprising:

loop means for mounting at least one sprue pin luted to a wax pattern; and, spiral arm means mounted to the loop means and extending inwardly of the loop means and out of the plane of the loop means and terminating in a base element for forming in combination with the loop means and the sprue pin a sprue channel in the mold.

2. The apparatus of claim 1 wherein the spiral arm means comprises at least two spiral arms extending from the loop means at angles which reduce turbulence of casting material introduced into the mold produced through use of the apparatus.

3. The apparatus of claim 1 wherein the base element is formed with a depression in an upper face thereof.

4. The apparatus of claim 3 wherein the depression is multi-faced and wherein the spiral arm means comprise a plurality of spiral arm elements, the number of the faces being equal to the number of the spiral arm elements, each face being aligned with one of the spiral arm elements.

5. The apparatus of claim 3 wherein the depression has three faces and the apparatus comprises three spiral arm elements.

6. The apparatus of claim 1 wherein the spiral arm means comprise at least three spiral arm elements connecting the loop means with the base element.

7. The apparatus of claim 6 wherein the spiral arm elements extend from the loop means at angles thereto which reduce the turbulence of casting material introduced into the mold produced through use of the apparatus.

8. The apparatus of claim 7 wherein the angles are 45°.

9. The apparatus of claim 7 wherein at least the one sprue pin is luted to the loop means at an angle which is the same as or similar to the angle at which the spiral arm elements join the loop means.

10. The apparatus of claim 9 wherein the angles are 45°.

11. The apparatus of claim 9 wherein at least the one sprue pin tilts outwardly of the loop means.

12. The apparatus of claim 1 and further comprising nib means formed on a lower face of the base element for connecting the apparatus to a sprue base.

13. The apparatus of claim 1 wherein at least the loop means, spiral arm means and base element form a sprue channel in the mold on removal thereof from the mold produced through use of the apparatus, the apparatus further comprising means formed in the base element for providing a low impact entry of casting material into those portions of the sprue channel formed by the spiral arm means.

14. The apparatus of claim 13 wherein the means formed in the base element comprises a depression formed in the base element in an upper face of the base element.

15. The apparatus of claim 14 wherein the depression is triangular.

16. The apparatus of claim 15 wherein the depression has regularly spaced faces.

17. The apparatus of claim 16 wherein the spiral arm means comprise three spiral arm elements, each face being aligned with one each of the spiral arm elements.

18. The apparatus of claim 17 wherein the spiral arm elements each join the loop means at an angle thereto which reduces the turbulence of casting material introduced into the mold produced through use of the apparatus.

19. The apparatus of claim 14 wherein the means formed in the base element comprises a multi-faced depression.

20. The apparatus of claim 19 wherein the spiral arm means comprise a plurality of spiral arm elements, the number of the faces being equal to the number of the spiral arm elements, each face being aligned with one each of the spiral arm elements.

21. The apparatus of claim 20 wherein the spiral arm elements each join the loop means at an angle thereto which reduces the turbulence of casting material introduced into the mold produced through use of the apparatus.

22. The apparatus of claim 1 wherein the base element is annular.

23. A method for fabricating a mold, comprising the steps of:

mounting a sprue loop to a sprue base, the loop including a loop element and spiral arms attached to the loop element and extending inwardly of the loop element and out of the plane of the loop element and terminating in a base element;

spruing at least one sprue pin and wax pattern attached thereto to the loop element at an angle to the loop element which is similar to that angle at which the spiral arms are attached to the loop element; and, forming an investment mold about the sprue loop to define a sprue channel shaped according to the definition provided by the sprue loop and the sprue pin.

24. The method of claim 23 wherein three spiral arms are attached to the loop element.

25. The method of claim 23 wherein the angle is 45°.

26. In the apparatus of claim 25 wherein the arm means comprise at least three arm elements connecting the loop means with the base element.

27. In the apparatus of claim 26 wherein the arm elements are regularly spaced about the loop means.

28. A mold comprising a mold body formed of solidified investment material and having a sprue channel defined internally thereof on removal of a sprue loop and at least one sprue pin and wax pattern attached to a loop element of the sprue loop, the sprue loop further comprising spiral arms elements attached to the loop element and extending inwardly of the loop element and out of the plane of the loop element and terminating in a base element.

29. The mold of claim 28 and further comprising means formed in the sprue channel at the entry of said sprue channel for causing a low impact entry of molten metal into the sprue channel.

30. The mold of claim 29 wherein the first-mentioned means comprise a portion of the solidified investment material formed by a depression formed in an upper face of the base element.

31. The method of claim 30 wherein the portion of the solidified investment material has triangularly shaped substantially planar faces forming perimetric surface portions thereof.

32. The mold of claim 31 wherein the portions of the sprue channel formed by each of the spiralarm elements are aligned with one each of the faces.

33. The mold of claim 32 wherein the portions of the sprue channel formed by the spiral arm elements are three in number and are regularly spaced about the portion of the sprue channel formed by the loop element and the faces are three in number.

34. The mold of claim 28 wherein the portions of the sprue channel formed by the spiral arm elements enter the portion of the sprue channel formed by the loop element at an angle thereto which reduces the turbulence of casting material introduced into the mold.

35. The mold of claim 34 wherein the angle is 45°.

36. The mold of claim 34 wherein the portion of the sprue channel formed by at least the one sprue pin enters the portion of the sprue channel formed by the loop element at an angle which is the same as or similar to the angle at which the portions of the sprue channel formed by the spiral arm elements enter the portion of the sprue channel formed by the loop element.

37. The mold of claim 36 wherein the angles are 45°.

38. The mold of claim 34 wherein the portions of the sprue channel formed by the spiral arm elements are three in number and are regularly spaced about the portion of the sprue channel formed by the loop element.

39. In an apparatus useful in the fabrication of a mold having a sprue channel, the sprue channel being at least partially formed by at least one sprue pin and wax pattern luted to the sprue pin, the apparatus being mountable to a sprue base, the improvement comprising:

a base element mountable to the sprue base;

loop means for mounting at least one sprue pin and wax pattern luted together; and, spiral arm means mounted to the loop means and extending inwardly of the loop means and out of plane of the loop means for forming portions of the sprue channel on removal from the mold produced through use of the apparatus, which portions of the sprue channel minimize turbulence of casting material introduced into the mold, the portions of the sprue channel formed by the arm means further channeling the casting material to the loop means, the arm means terminating in connection to the base element, the base element, the arm means, the loop means and the sprue pin and wax pattern luted together forming in combination said sprue channel in the mold on removal thereof from the mold produced through use of the apparatus.

40. In the apparatus of claim 39 wherein the arm elements extend from the loop means in directions thereto which reduce the turbulence of the casting material introduced into the mold produced through use of the apparatus.

41. In the apparatus of claim 40, wherein the directions in which the arm elements extend from the loop means are locally similar or equal.

42. In the apparatus of claim 39, wherein the arm elements extend from the loop means at angles thereto which reduce the turbulence of the casting material introduced into the mold produced through use of the apparatus and wherein at least the one sprue pin is luted to the loop means at an angle which is the same as or similar to the angle at which the spiral arm elements join the loop means.

43. In the apparatus of claim 42 wherein the angles are 45°.

44. In the apparatus of claim 39 wherein the improvement further comprises means formed in the base element for providing in the mold produced through use of the apparatus a low impact entry of casting material into those portions of the sprue channel formed by the arm means.

45. In the improvement of claim 44 wherein the means formed in the base element comprise a depression formed in the base element in an upper face of the base element.

46. In the improvement of claim 45 wherein the depression has a plurality of faces and wherein the arm means comprise a plurality of arm elements, the number of the faces being equal to the number of the arm elements, each face being aligned with one each of the arm elements.

47. In the improvement of claim 46 wherein the arm elements and the faces are three in number.

48. In the apparatus of claim 47 wherein the arm elements each join the loop means in a direction thereto which reduces the turbulence of the casting material introduced into the mold produced through use of the apparatus.

49. In the apparatus of claim 39 wherein the arm means comprise at least two arm elements connecting the loop means with the base element.

* * * * *